US009491838B2

(12) United States Patent
Frattini et al.

(10) Patent No.: US 9,491,838 B2
(45) Date of Patent: Nov. 8, 2016

(54) LED MATRIX MANAGER

(71) Applicant: Texas Instruments Incorporated, Dallas, TX (US)

(72) Inventors: Giovanni Frattini, Pavia (IT); Evan Reutzel, Center Valley, PA (US); Jeffrey Morroni, Littleton, CO (US); Ali Djabbari, Saratoga, CA (US); Gerard Socci, Palo Alto, CA (US); Gianpaolo Lisi, Los Gatos, CA (US); Raj Subramoniam, Cupertino, CA (US); Kosha Mahmodieh, Hayward, CA (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 171 days.

(21) Appl. No.: 13/690,235

(22) Filed: Nov. 30, 2012

(65) Prior Publication Data

US 2013/0193852 A1 Aug. 1, 2013

Related U.S. Application Data

(60) Provisional application No. 61/591,220, filed on Jan. 26, 2012, provisional application No. 61/593,624, filed on Feb. 1, 2012, provisional application No. 61/591,223, filed on Jan. 26, 2012, provisional application No. 61/591,215, filed on Jan. 26, 2012, provisional application No. 61/591,226, filed on Jan. 26, 2012.

(51) Int. Cl.
*G09G 3/00* (2006.01)
*G09G 5/00* (2006.01)
(Continued)

(52) U.S. Cl.
CPC ..... *H05B 37/036* (2013.01); *H05B 33/083* (2013.01); *H05B 33/0842* (2013.01); *H05B 37/02* (2013.01)

(58) Field of Classification Search
CPC ..... H05B 33/083; H05B 33/0815; H05B 33/0827; H05B 33/0818; H05B 33/0851; H05B 33/0806; H05B 33/0824
USPC ..... 315/276, 277, 279, 280, 282, 283, 284, 315/291, 307, 200 R, 209 R; 363/122, 125, 363/126, 130, 136
See application file for complete search history.

(56) References Cited

U.S. PATENT DOCUMENTS 7,649,326 B2 1/2010 Johnson et al.
7,994,725 B2 8/2011 Bouchard
(Continued)

FOREIGN PATENT DOCUMENTS

CN 102318440 A 1/2012
JP 2010123644 3/2010
KR 101059182 8/2011

OTHER PUBLICATIONS

PCT Search Report mailed May 9, 2013.
(Continued)

*Primary Examiner* — Dedei K Hammond
(74) *Attorney, Agent, or Firm* — William B. Kempler; Frank D. Cimino

(57) ABSTRACT

Circuits for controlling a plurality of LEDs connected in series are disclosed herein. The circuit includes a plurality of switches, wherein each switch is connectable between the anode and cathode of one of the plurality of LEDs. Each of the switches has a first state wherein current does not pass through the switch and a second state wherein current passes through the switch. The circuit also includes an input for receiving data to program the switches and a data line for transferring data between a circuit controlling second LEDs that are connected in parallel with the first LEDs and the circuit. In addition, the circuit includes a data output for transferring data to other circuits controlling third LEDs that are connected in series with the first LEDs.

22 Claims, 8 Drawing Sheets

(51) Int. Cl.

| | |
|---|---|
| ***H05B 37/03*** | (2006.01) |
| ***H05B 37/02*** | (2006.01) |
| ***H05B 33/08*** | (2006.01) |

(56) References Cited

U.S. PATENT DOCUMENTS

| | | | | |
|---|---|---|---|---|
| 8,587,217 | B2 * | 11/2013 | Melanson | 315/294 |
| 2005/0122057 | A1 * | 6/2005 | Chen et al. | 315/224 |
| 2007/0159750 | A1 * | 7/2007 | Peker et al. | 361/93.1 |
| 2007/0262724 | A1 * | 11/2007 | Mednik et al. | 315/125 |
| 2008/0191642 | A1 * | 8/2008 | Slot et al. | 315/295 |
| 2008/0297065 | A1 * | 12/2008 | Mubaslat et al. | 315/291 |
| 2009/0295776 | A1 * | 12/2009 | Yu et al. | 345/212 |
| 2011/0148306 | A1 * | 6/2011 | Ger et al. | 315/125 |
| 2011/0210674 | A1 | 9/2011 | Melanson | |
| 2012/0007515 | A1 * | 1/2012 | Krummel | 315/200 R |
| 2012/0268036 | A1 * | 10/2012 | Dubrovsky | 315/307 |

OTHER PUBLICATIONS

Chinese Publication Search Report cited in corresponding Chinese Application No. CN 104106315 A, mailed Aug. 4, 2015 (2 pages).

* cited by examiner

LED MATRIX MANAGER

This application claims priority from the following United States Provisional patent applications:

U.S. provisional patent application 61/591,220 filed on Jan. 26, 2012 for METHOD OF CONNECTING TWO BUCK CURRENT REGULATORS IN SERIES WHILE INSURING INPUT VOLTAGE BALANCING;

U.S. provisional patent application 61/593,624 filed on Feb. 1, 2012 for LED MATRIX MANAGER;

U.S. provisional patent application 61,591,223 filed on Jan. 26, 2012 for OPTIMAL STAGGERING CONTROL OF DIMMABLE LED ARRAYS;

U.S. provisional patent application 61/591,215 filed on Jan. 26, 2012 for ULTRA FAST-RESPONSE CURRENT SOURCE FOR STRINGS OF INDIVIDUAL DIMMAGLE LEDS IN SERIES; and U.S. provisional patent application 61/591,226 filed on Jan. 26, 2012 for LOW-COST BIAS VOLTAGE GENERATION CIRCUIT FOR HIGH-VOLTAGE CURRENT REGULATORS.

BACKGROUND

Many lighting applications are moving from conventional light sources to light-emitting diode (LED) sources. One area where LEDs are used is in display boards where the LEDs are arranged in strings wherein the LEDs are connected in series. One problem with arranging LEDs in strings is that all the LEDs in the string are managed together. For example, all the LEDs are turned off and on, and thus dimmed, together. The LEDs are not controlled individually. In addition, if one LED becomes dysfunctional with an open circuit, the entire string of LEDs may become dysfunctional and there is no way for a controller to resolve the problem.

SUMMARY

Circuits for controlling a plurality of LEDs connected in series are disclosed herein. The circuit includes a plurality of switches, wherein each switch is connectable between the anode and cathode of one of the plurality of LEDs. Each of the switches has a first state wherein current does not pass through the switch and a second state wherein current passes through the switch. The circuit also includes an input for receiving data to program the switches and a data line for transferring data between a circuit controlling second LEDs that are connected in parallel with the first LEDs and the circuit. In addition, the circuit includes a data output for transferring data to other circuits controlling third LEDs that are connected in series with the first LEDs.

DETAILED DESCRIPTION

Figure 1:
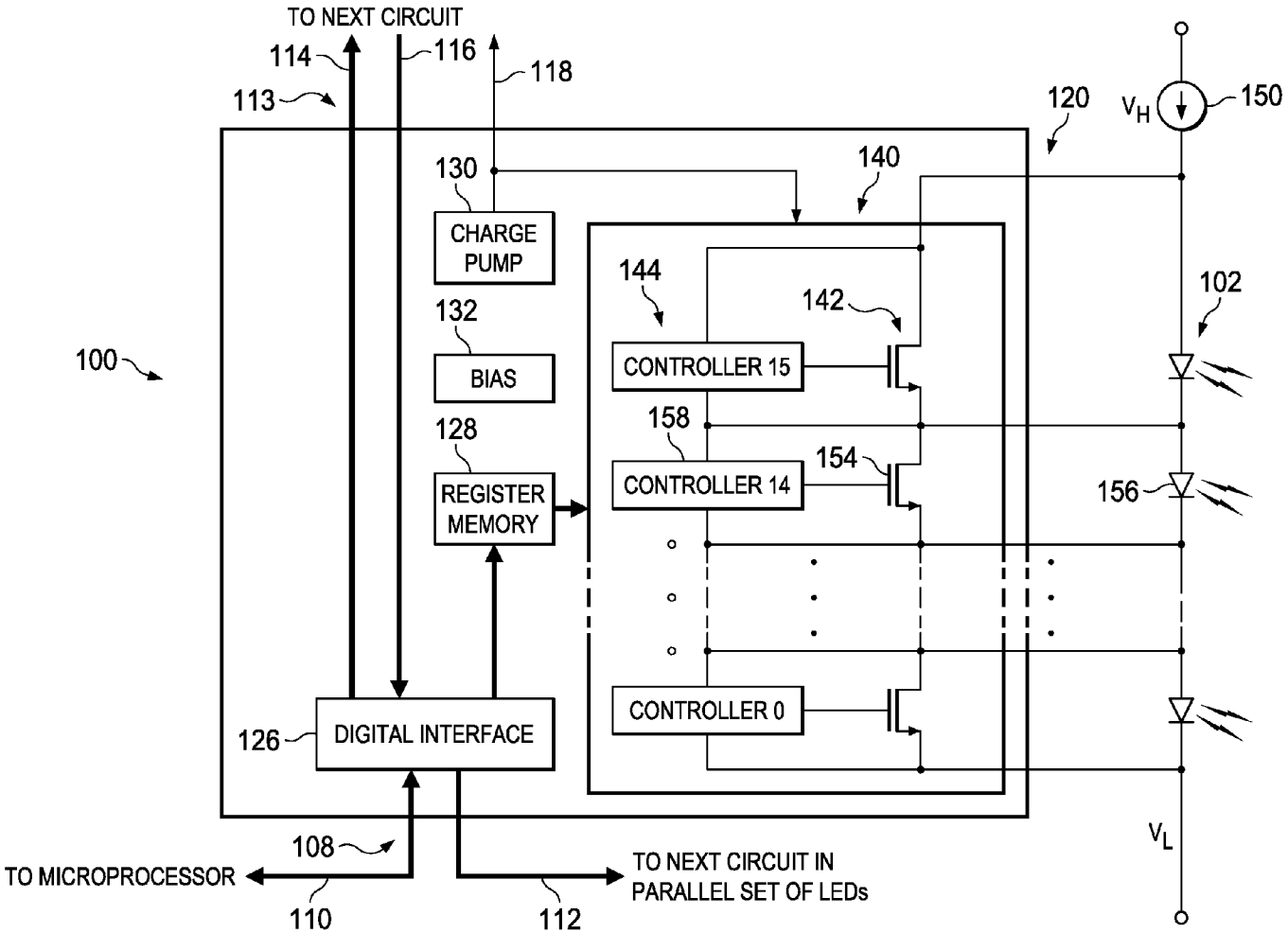
FIG. 1 is a block diagram of an embodiment of a circuit for controlling a plurality of LEDs.

Circuits for controlling a plurality of LEDs are disclosed herein. A block diagram of an embodiment of a circuit 100 is shown in FIG. 1. The circuit 100 drives a plurality of LEDs 102, wherein the LEDs 102 are connected in series so that the cathode of one LED is connected to the anode of another LED. The circuit 100 has several ports for transmitting and/or receiving digital or binary data signals. A first port 108 has an input 110 that is connectable to a microprocessor or other circuit (not shown in FIG. 1). The microprocessor sends data to the circuit 100 regarding the operation of the LEDs 102. The first port 108 also has a line 112 that is connectable to another circuit that is identical or substantially identical to the circuit 100. This other circuit may control a different plurality of LEDs as described in greater detail below. A second port 113 has an output 114 and an input 116 that are connectable to another circuit (not shown in FIG. 1) that controls LEDs that may be connected in series with the LEDs 102. The circuit 100 also has a power connection 118 that is connectable to another circuit (not shown in FIG. 1) or a power source.

The circuit 100 has a plurality of terminals 120 that are connectable to the LEDs 102. Each terminal 120 is connectable to an anode or cathode of one of the LEDs 102. Therefore, there is one more terminal 120 than the number of LEDs 102. For example, if the circuit 100 is capable of controlling sixteen LEDs 102, there must be seventeen terminals 120. As described below, the terminals 120 provide bypass circuits for each of the LEDs 102 so that the terminals 120 provide mechanisms for turning each of the LEDs 102 on and off.

The circuit 100 includes several internal circuits that perform a variety of functions. A digital interface 126 receives and transmits data to and from the microprocessor and other circuits by way of the first port 108 and the second port 113. The digital interface 126 receives data from the input 110, which is connectable to another circuit or a microprocessor. The digital interface 126 may perform initial analysis of the data to determine where the data should be transmitted. In some situations, the data is transmitted to another circuit by way of the line 112 or the output 114. The digital interface 126 may also receive data from the other circuit by way of the input 116. It is noted that in some embodiments, first port 108 may process two-way data. Accordingly, the line 112 may receive data from other circuits and pass the data to the microprocessor by way of the input 110.

As briefly described above, the data received by the circuit 100 may be intended for the circuit 100, in which case it may be transferred to a register memory 128. The register memory 128 decodes and/or stores the data so that it can ultimately be used to operate the LEDs 102. The data may contain information to individually control the LEDs 102. For example, the data may contain information as to how long each of the LEDs 102 is to remain on or off, which enables pulse width modulation (PWM) to control the brightness of each of the LEDs 102.

A charge pump 130 provides the correct voltage to operate the circuit 100 from the voltage used to operate the LEDs 102. As described below, the use of the charge pump 130 enables the circuit 100 to operate from the relatively high voltage that is used to drive the LEDs 102. The charge pump 130 may also supply power to another circuit (not shown in FIG. 1) so that the other circuit does not need to be connected to a separate power supply. A bias circuit 132 may receive power from the charge pump 130 so as to provide the operating voltage for the different components within the circuit 100.

A switching circuit 140 receives data from the register memory 128 and power from the charge pump 130 or bias 132 to operate the LEDs 102. In a simple form shown in FIG. 1, the switching circuit 140 has a plurality of switches 142 that are connectable between the anodes and cathodes of each of the LEDs 102. The switches 142 depicted herein are FETs, but other forms of switches could be used in the circuit 100. The switches 142 are controlled by controllers 144, wherein each switch is connected to a controller.

Having described the components of the circuit 100, the operation of the circuit 100 will now be described. More detailed embodiments of the components within the circuit 100 and descriptions of their operations are described further below.

Data from a microprocessor or controller (not shown in FIG. 1) is received at the input 110 and is transmitted to the digital interface 126. The digital interface 126 determines where the data should be transmitted. For this description, it is assumed that the data received is meant to control the LEDs 102 that are connected to the terminals 120 of the circuit 100. The data includes information as to which of the LEDs 102 is to be illuminated and the brightness of each of the LEDs 102. This information is stored and/or decoded by the register memory 128.

A current source 150 drives the LEDs 102, which causes them to illuminate. All of the switches 142 may be normally open, so current normally passes through all of the LEDs 102, which puts them in a state where they are normally on. The data in the register memory 128 instructs the controllers 144 to open or close individual switches 142. Open switches 142 will turn on their associated LEDs 102 and closed switches 142 will turn off their associated LEDs 102. Reference is made to an individual switch 154 and its associated individual LED 156 and controller 158. As shown in the circuit 100, when the switch 154 is open, the LED 156 has current from the current source 150 passing through it and it illuminates. By closing the switch 154, the current bypasses the LED 156, which turns the LED 156 off. By turning the switch 154 on and off, such as by using PWM, the brightness of the LED 156 can be controlled. The current source 150 has been shown as being connected to the top of the string of LEDs 102, which is the anode end of the string. However, the current source 130 could also be connected to the bottom of the string of LEDs 102, which is closest to the cathode end of the string.

Figure 2:
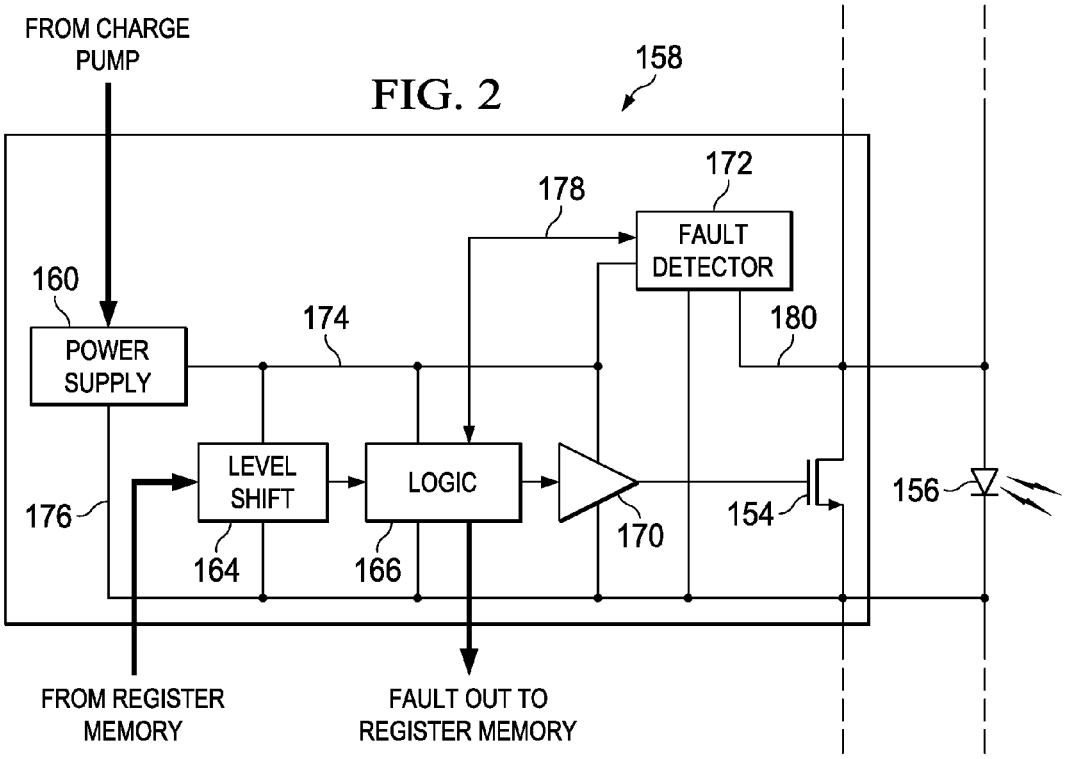
FIG. 2 is a schematic diagram of a controller of the circuit of FIG. 1.

A more detailed embodiment of the controller 158 is shown in FIG. 2. The controller 158 controls the switch 154, which controls the LED 156. The controller 158 is representative of all the controllers 144 in the circuit 100, FIG. 1. The controller 158 may include a local power supply 160 that may be connected to the charge pump 130, FIG. 1. The power supply 160 regulates the voltage received from the charge pump 130 so that it can operate the components within the controller 158. The power supply 160 may also reference the voltage to a common ground potential used by the controller 158. Due to the use of the charge pump 130, FIG. 1, the ground potentials of different circuits may vary, so a common ground is used with respect to the controller 158. The power supply is referenced to the cathode of the LED 156 in order for the switch 154 to be able to turn it off and on. As described below, the charge pump 130 generates a voltage that is high enough for the controller 158 to operate the switch 154, wherein this voltage may be higher than the voltages required to operate other components of the circuit 100.

A level shift circuit 164 (sometimes referred to herein simply as a "level shift 164") receives data from the registry memory 128, FIG. 1. The data contains information as to how bright the LED 156 should illuminate. In some embodiments, the register memory 156 transmits a PWM signal to the level shift 164. In other embodiments, the register memory 128 transmits a value to the level shift 164 indicating the brightness of the LED 156. The level shift 164 may then generate a drive signal for the LED 156, which may be a PWM signal.

The level shift 164 may convert the received data signal to voltages that can be used by the controller 158. As described in greater detail below, the circuit 100, FIG. 1, may operate at a different voltage than other circuits (not shown in FIG. 1) that are connected to the circuit 100. For example, the ground of one circuit may be at a different potential than the ground of another circuit. Likewise the controllers 144, FIG. 1, may all operate at different voltage potentials. This may cause the data signals to be at different voltage potentials. The level shift 164 converts the data signals to voltage potentials that operate within the controller 158.

The level shift 164 is connected to a logic circuit 166. The logic circuit 166, among other things, tests the functionality of the LED 156 and determines whether the switch 154 should be open or closed based on the functionality. The logic circuit 166 may also transmit data to the register memory 128 as to the status of the LED 156. The logic circuit 166 drives a driver 170, which may be an amplifier or buffer that drives the gate of the switch 154. A fault detector 172 tests the LED 156 to determine if it is functional. If the LED 156 is not functional, a signal is transmitted to the logic circuit 166 to cause the switch 154 to remain closed.

The operation of the controller 158 will now be described. Power is supplied to the power supply 160 from the charge pump 130, FIG. 1. The power supply 160 outputs a regulated voltage on a line 174 that is referenced relative to a common voltage on a line 176. The voltage on the line 174 powers the components within the controller 158 and is high enough to turn the switch 154 on. In order to operate the switch 154, a voltage must be applied to the gate terminal that is higher than the voltage on the other two terminals, drain and source, connected to the LED 154. Because the LED 154 could be the top of the string of LEDs 102, its anode can be connected directly to the current source 150. The charge pump 130 generates a voltage higher than the voltage on the anode in order to ensure that the power supply 160 can generate a voltage for the driver 170 that can keep the gate of the switch 154 at a voltage that is higher than the voltage on the anode even when the switch 154 is on.

The fault detector 172 tests the LED 156. The logic circuit 166 may receive instructions to cause the fault detector 172 to test the LED 156. The test on the LED 154 involves the fault detector 172 sending a signal to the logic circuit 166 via the line 178 that causes the switch 154 to open. The LED 156 should illuminate and have a forward voltage drop between its anode and cathode. This forward voltage drop is measured by a line 180 relative to the common line 176. If the forward voltage is correct, the LED 156 is operating correctly. If the forward voltage is zero, then the LED 156 is shorted. If the forward voltage is greater than the forward operating voltage of the LED 156 then the LED 156 is open. If the LED is not operating correctly, the fault detector 172 sends a signal to the logic circuit 166 that causes the switch 154 to remain closed, which bypasses the LED 156. If the LED 156 is open, bypassing the LED 156 will not cause the other LEDs 102, FIG. 1, connected in series with the LED 156 to fail to illuminate.

If the fault detector 172 determines that the LED 156 is operating properly, it sends a signal to the logic circuit 166 by way of the line 178 that enables the logic circuit 166 to control the illumination of the LED 156. During normal operation, a data value may be received by the level shift 164 from the register memory 128, FIG. 1, wherein the data value is indicative of the brightness required for the LED 156. The level shift 164 may convert the data to pulses in the form of a (PWM) signal, wherein the longer pulses cause the LED 156 to illuminate for greater periods, which makes the LED 156 appear brighter.

The signals from the level shift 164 are transmitted to the logic circuit 166. Because the fault detector 172 determined that the LED 156 is operating properly, the logic circuit 166 passes the signals to the driver 170. The driver 170 drives the gate of the switch 154. When the switch is open, the LED 156 illuminates. Therefore, the driver 170, or other components in the circuit 100, may invert the (PWM) signal so that the logic high pulses open the switch 154 and cause the LED 170 to illuminate.

Referring again to FIG. 1, each of the controllers 144 may operate in the same manner as the controller 158 described in FIG. 2. Accordingly, each of the LEDs 102 connected to the circuit 100 may be controlled individually. For example, data may be received by the digital interface 126 and transmitted to the register memory 128. Based on the data, the register memory 128 may output data to the individual controllers 144 to indicate the amount of time that their corresponding LEDs 102 are to be illuminated.

As shown in FIG. 1, the LEDs 102 are driven by a current source 150. The current source 150 needs to provide a constant current irrespective of the cumulative voltage build up on the LEDs 102. For example, if all the LEDs 102 are illuminating, the voltage on the string of LEDs 102 will be the sum of the individual forward voltages of all the LEDs 102. As individual LEDs 102 are turned off, the cumulative voltage decreases, however, the current through the LEDs 102 must remain constant or the illumination of the LEDs 102 will change.

Figure 3:
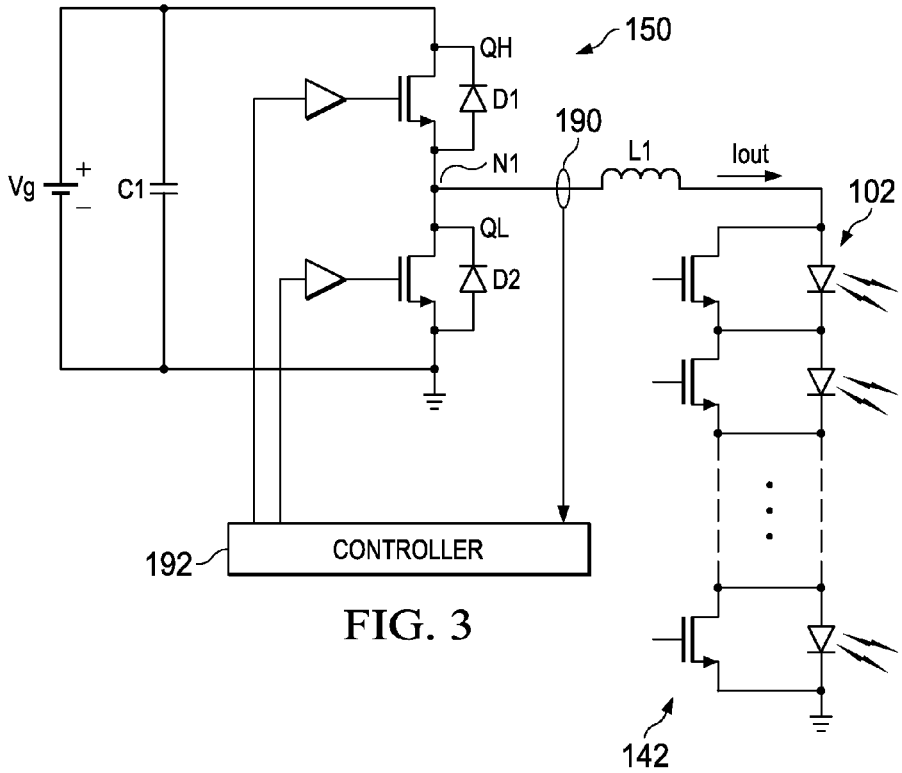
FIG. 3 is a schematic diagram of an embodiment of the current source of FIG. 1.

A detailed schematic of an embodiment of the current source 150 is shown in FIG. 3, wherein the current source 150 is a constant current source. The current source 150 includes a DC voltage supply Vg, sometimes referred to simply as the supply Vg. The voltage supply Vg is referenced to ground, which may be the same potential as the end of the string of LEDs 102. For reference, the voltage supply Vg has a positive line and a negative line, wherein the negative line is connected to ground.

A capacitor C1 is connected between the positive line and the negative line of the voltage supply Vg. A first switch QH is connected between the positive line and a node N1. A second switch QL is connected between the node N1 and the negative line. In the embodiment of FIG. 3, the switches QH, QL are FETs wherein the drain of QH is connected to the positive line and the source of QL is connected to the negative line. A diode D1 is connected between the source and drain of QH and a diode D2 is connected between the source and drain of QL. The diodes D1, D2 attenuate transients that may occur across QH and QL.

The node N1 is connected to an inductor L1, which is connected to the LEDs 102. Therefore, the current required to operate the LEDs 102 flows through the inductor L1. It is noted that there are no capacitors connected across or in parallel with the string of LEDs 102. A current sensor 190 measures the current flow through the inductor L1, and thus, through the LEDs 102. The current sensor 190 and the gates of QH and QL are connected to a controller 192, which turns the switches QH and QL off and on.

The controller 192 turns the switches QH and QL off and on to regulate the current that passes through the inductor L1. The current sensor 190 measures the current flow through the inductor L1 and outputs data related to the current flow to the controller 192. The controller 192 changes the open and closed times of the switches QH and QL in order to maintain the current necessary to operate the LEDs 102. For example, if more current is required by the LEDs 102, the controller 192 may open QL and close QH for longer periods. The storage properties of the inductor L1 work to maintain a constant current by enabling rapid voltage changes. Therefore, the inductor L1 can absorb voltage changes as a result of the LEDs 102 turning off and on while maintaining a constant current flow through the LEDs 102. As described above, there is no capacitor connected in parallel with the LEDs 102. Therefore, the voltage that appears at the top of the LEDs 102 where current source 150 is connected can change very rapidly.

Figure 4:
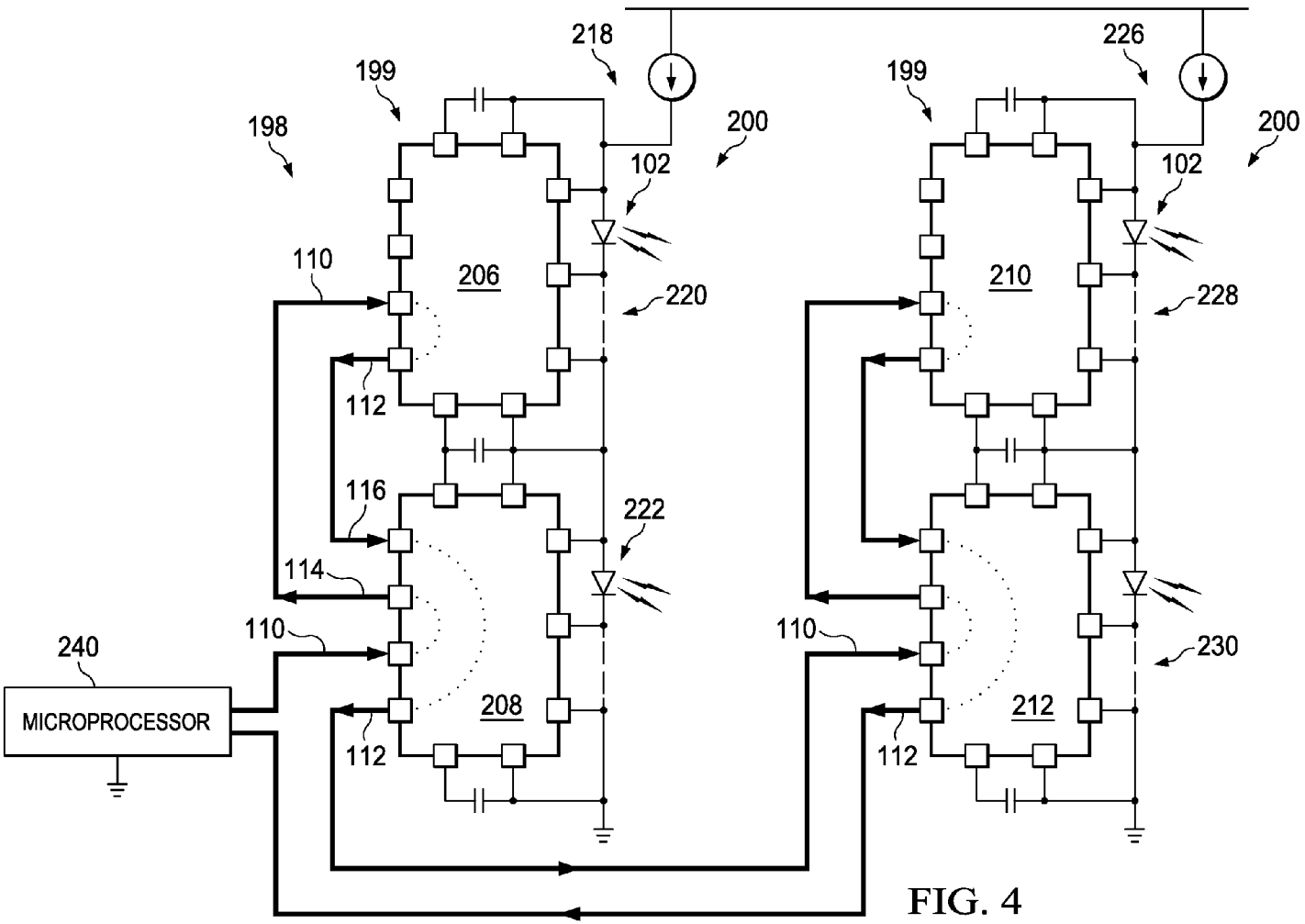
FIG. 4 is a block diagram of a plurality of circuits connected together to operate an array of LEDs.

Having described the operation of the current source 150, the connection between several circuits will now be described. As briefly described above, several circuits 100 may be connected together in order to control an array of LEDs. An example of the circuits 100 connected together to form a device 198 is shown in FIG. 4, which is a schematic illustration of a plurality of circuits 199 connected together to operate an array 200 of LEDs 102. The circuits 199 are identical to the circuit 100, FIG. 1, are referred to individually as the first circuit 206, the second circuit 208, the third circuit 210, and the fourth circuit 212. The first and second circuits 206, 208 operate a first string of LEDs 218, wherein the first circuit 206 operates a first portion of LEDs 220 and the second circuit 208 operates a second portion of LEDs 222. The third and fourth circuits 210, 212 operate a second string of LEDs 226, wherein the third circuit 210 operates a third portion of LEDs 228 and the fourth circuit 212 operates a fourth portion of LEDs 230.

The array 200 is shown with the first string of LEDs 218 and the second string of LEDs 226 connected in parallel. It is noted that the strings of LEDs 218, 226 are in parallel, but they may not necessarily be electrically connected in parallel. Any number of parallel strings of LEDs may be added to the array 200. Likewise the strings of LEDs 218, 226 each only have two portions that are connected in series. The strings of LEDs 218, 226 may be expanded to include any number of portions. The use of a larger array 200 enables the array 200 to display more information by having more LEDs 102 that may be illuminated.

A microprocessor 240 is connected to the data lines that are connected to the circuits 199. The microprocessor 240 transmits data to all the circuits 199 that includes information as to which LEDs 102 are to be illuminated and the period of illumination. For example, the data may include header information that determines which of the circuits 199 is to receive the data, followed by illumination data for each of the LEDs connected to that particular circuit. The microprocessor 240 transmits data to the input 110 of the second circuit 208. As shown in FIG. 1, the input 110 is connected to a digital interface 126, FIG. 1. If the data received is meant to operate the second portion of LEDs 222 connected to the second circuit 208, the digital interface 126, FIG. 1, will process the data and transmit it to the register memory 128, FIG. 1. Otherwise, the digital interface 126 transmits the data to the output 114, which is connected to the input of the first circuit 206. As with the second circuit 208, the digital interface 126 determines if the data is meant to operate the portion of LEDs 220 connected to the first circuit 206.

The first circuit 206 is located at the top of the first string of LEDs 218. Therefore, the first circuit 206 will not transmit data to any other circuits associated with the first string of LEDs 218. The first circuit 206 may detect that there are no circuits connected to the input 116 and the output 114, or the first circuit 206 may be programmed to function as the top circuit in the string of LEDs 218. The digital interface 126, FIG. 1, will either save the data received on the input 110 or transmit the data to the line 112. In other embodiments, the output 114, and the input 116 of the first circuit 206 may be electrically connected to each other. Regardless of the embodiment, the data not meant for the first circuit 206 is transmitted on the line 112 to the next circuit in the first string of LEDs 218, which is the second circuit 208.

Data received on the input 116 of the second circuit 208 is passed to the line 112 because the data has already been analyzed and is not meant for the second circuit 208. More specifically, if the data is received on the input 116, it has been analyzed by all the circuits in the string of LEDs 218 and is meant to be transmitted to a parallel string of LEDs. The line 112 of the second circuit 208 is connected to the input 110 of the fourth circuit 212. Therefore, data from the first string of LEDs 218 is transmitted to the second string of LEDs 226 and the above-described process is repeated. The line 112 of the fourth circuit 212 is connected back to the microprocessor 240. Data on this line may include locations of LEDs that were tested and that are not functioning. The microprocessor 240 may operate to lessen the visual impact of defective LEDs as known in the art.

Having described the data transmissions in the array 200, the power distribution will now be described. The string of LEDs 102 may have a relatively high voltage between the top LED and the bottom LED. In some embodiments, the voltage is approximately 100 volts. The components within a circuit 100 may operate on five volts. Circuits are disclosed herein that enable the high voltage operating the LEDs 102 to operate the low voltage components in the circuits 100.

Figure 5:
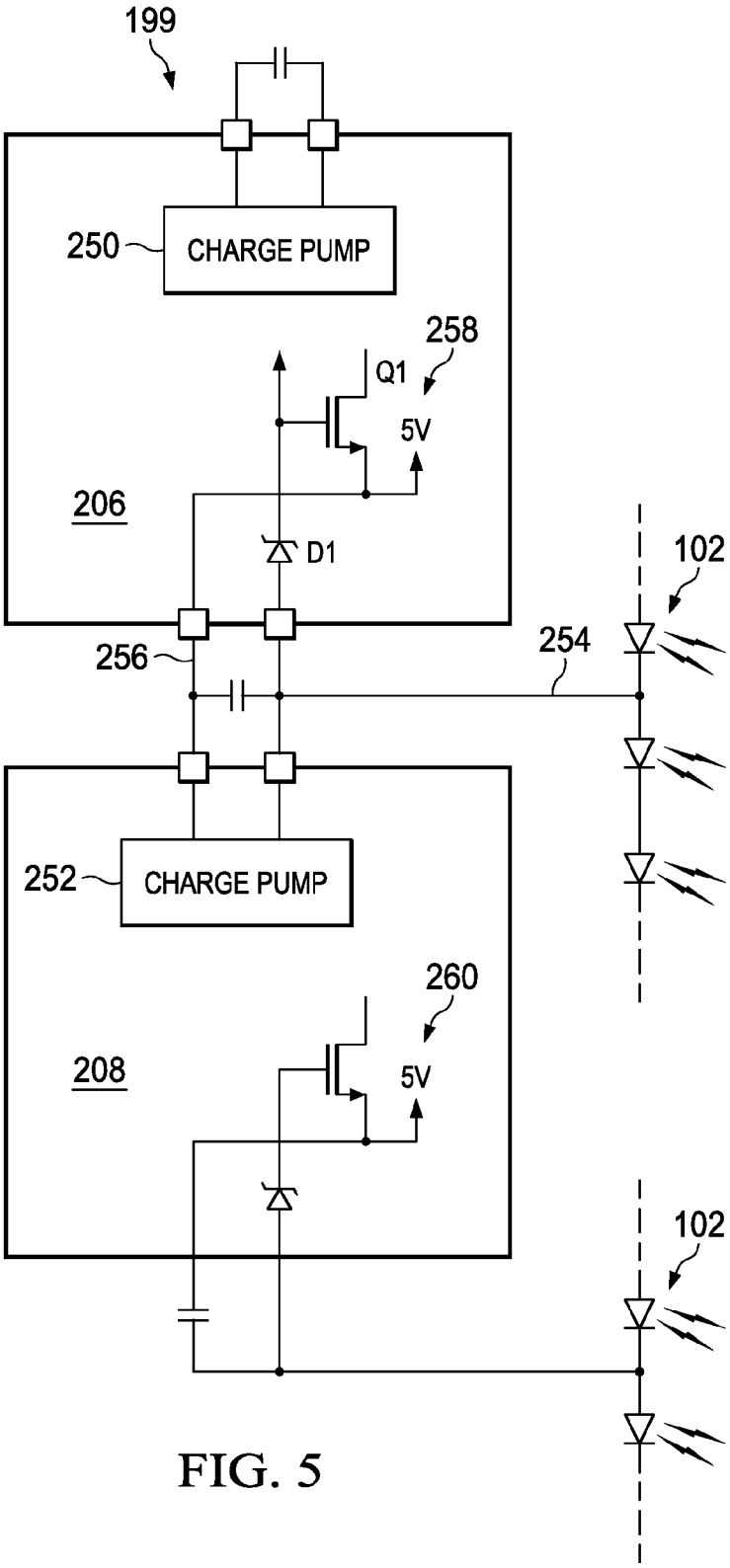
FIG. 5 is a schematic diagram of the power supply configuration between the circuits of FIG. 4.

The power may be supplied to the circuits 199 by use of the charge pump 130, which is connected to the LEDs 102. An embodiment of the power supply using the charge pump 130 is shown in FIG. 5, which is a schematic illustration of the first circuit 206 and the second circuit 208 connected together. In order for the circuits 206, 208 to receive power from the LEDs 102 and to drive the electronic components therein, charge pumps are used. A first charge pump 250 is located in the first circuit 206 and a second charge pump 252 is located in the second circuit 208. In summary, the charge pumps 250, 252 generate the proper operating voltage for the circuits 206, 208 from the voltage present across the LEDs 102. In the embodiments described herein, the charge pumps 250, 252 and associated voltage regulators generate the voltages required to operate the electronic components within the circuits 199.

In order to better describe the charge pumps, additional reference is made to FIGS. 1 and 2 and the charge pump 130. The charge pump 130 is powered by the string of LEDs 102. Therefore, the supply voltage for the charge pump is between the highest voltage at the anode at the top of the string of LEDs 102 and the cathode at the bottom of the string. When a switch 142 is on, the drain to source voltage drops. Ideally, the voltage drop is zero, but it may be a few millivolts. The voltage at the top LED that is off will not be high enough to operate its corresponding switch. The charge pump 130 generates this higher voltage to operate the switches 142.

There will be situations where all the switches 142 are on so that all the LEDs 102 are bypassed and the total voltage across the string of LEDs 102 can be as low as a few hundred millivolts. In this case all the controllers 140 need their supply voltage to be high enough to keep the switches on. In this situation, all the controllers 140 receive power from the charge pumps 130 so that they may operate at the higher voltage.

The circuits 199 also generate supply voltages using bias circuits 258, 260 which may be 5V above a common ground. The bias circuits 258, 260 supply power to the digital interface 126 and register memory 128. In the embodiment of FIG. 5, the first circuit 206 and the second circuit 208 are stacked to drive the string of LEDs 102, so the output of the charge pump 252 equals the output of the bias 258. Therefore, the output of the charge pump 252 and the output of the bias 258 can be connected together and share the load. Additionally, either the charge pump 252 or the bias 258 can be turned off if either can supply the required load by itself.

Figure 6:
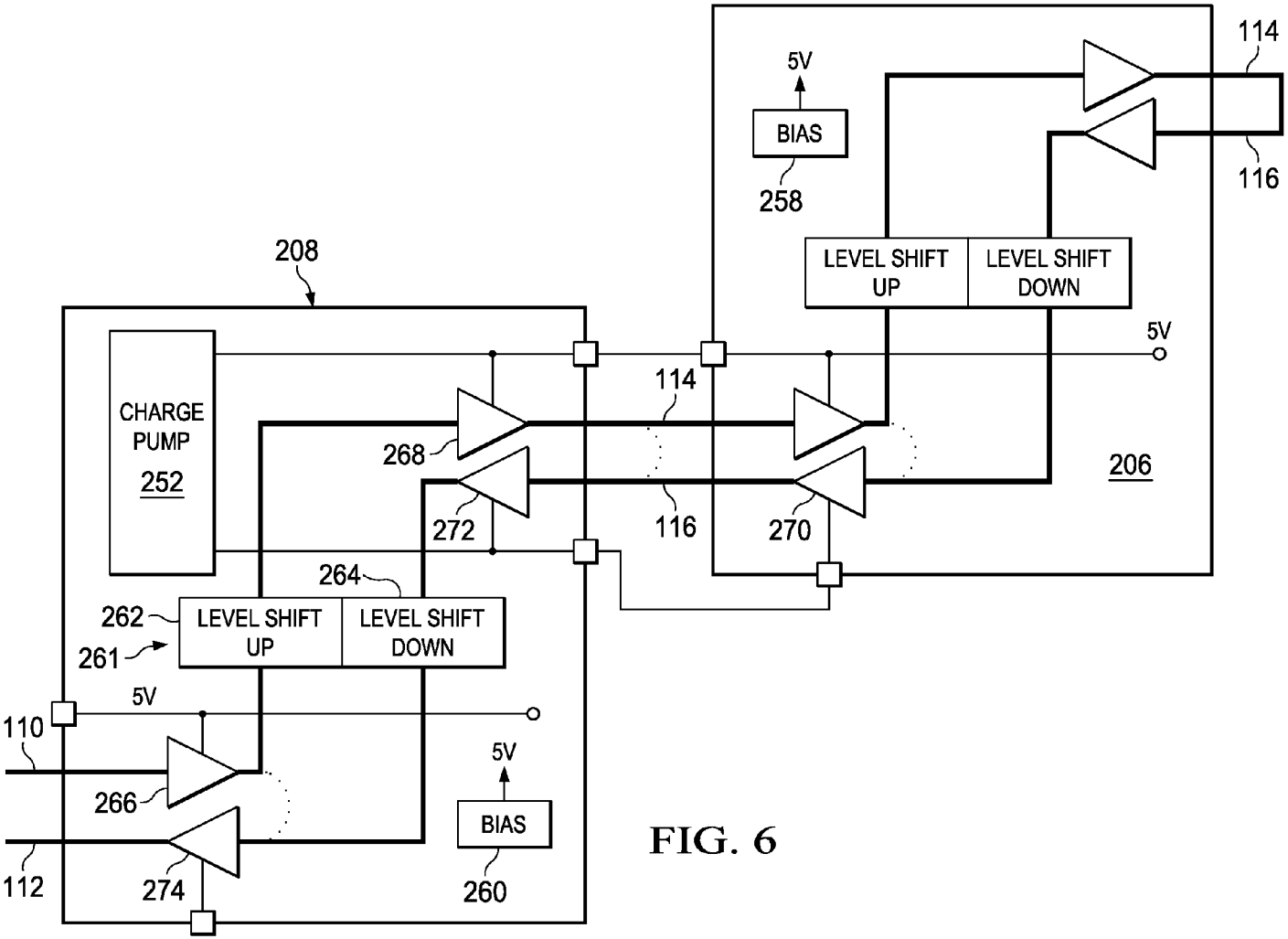
FIG. 6 is a schematic diagram of the data transmission between the circuits of FIG. 5.

As briefly described above, the power system in the circuits 206, 208 enable data transmissions between the circuits 206, 208 even though they operate at different potentials when referenced to a ground. An example of the power and data connections between the first circuit 206 and the second circuit 208 is shown in FIG. 6. In some embodiments, the voltage operating the first circuit 206 may be referenced to a ground node that is not at the same potential as the ground node of the second circuit 208. In order for the communications to operate correctly given the different voltage potentials, the circuits 206, 208 include level shifters 261. As shown with reference to the second circuit 208, the circuits 206, 208 may each have a level shift up 262 and a level shift down 264. The circuits 206, 208 also include a plurality of buffers/drivers as described below. Data registers and other components are connected to the data lines, but are not shown in FIG. 6.

Data is received on the line 110 by the second circuit 208. The data line 110 connects to a driver 266. The driver 266 operates from the voltage present in the second circuit 208, which is five volts in this embodiment. The driver 266 outputs the data to the level shift up 262 in order for the data to operate at the five volt potential present in the first circuit 206. The data may also be analyzed by the memory register 128, FIG. 1. The data is output from the level shift up 262 to a driver 268 that operates at the five volt potential present in the first circuit 206. The driver 268 outputs the data on the line 114 to the first circuit 206, which is substantially the same or identical to the second circuit 208.

The data being transmitted from the first circuit 206 to the second circuit 208 has to be shifted down due to the higher potential present in the first circuit 206 relative to the second circuit 208. A driver 270 transmits the data from the first circuit 206 to the line 116. The data is received by a driver 272 in the second circuit 208. Both the drivers 270, 272 operate at the potential present in the first circuit 206. The data is transmitted to the level shift down 264 where its potential is changed to operate at the voltage appropriate for the second circuit 208. An output driver 274 outputs the data signal from the level shift down 264 to the line 112.

If a circuit 100 is positioned at the top of the string of LEDs 200, FIG. 4, the data lines need to be connected together in order to allow the data to be transmitted to the other circuits. In the embodiment of FIG. 6, the first circuit 206 controls the first portion of LEDs 220, FIG. 4, at the top of the string 218. Therefore, data does not need to be transmitted further than the first circuit 206, so the output 114 and the input 116 of the second circuit 206 are connected together. In the embodiment of FIG. 6, an external line is used to connect the output 114 and the input 116. It is noted that the output 114 and the input 116 may be connected internally by electronic switches that are not shown in FIG. 6.

Referring again to FIGS. 3 and 4, the current source 150 supplies current to a plurality of LEDs 102. For example, each of the circuits 199 may control sixteen LEDs 102. When the circuits 199 are connected in a series, the current source 150 provides current to many LEDs 102. As the LEDs 102 turn off and on, the transients created by the off and on transitions need to be attenuated. With so many LEDs 102 connected to the current source 150, several LEDs may be simultaneously turning off and on. The parasitic capacitance to ground found at the switching nodes will charge and discharge rapidly causing these transients.

Figure 7:
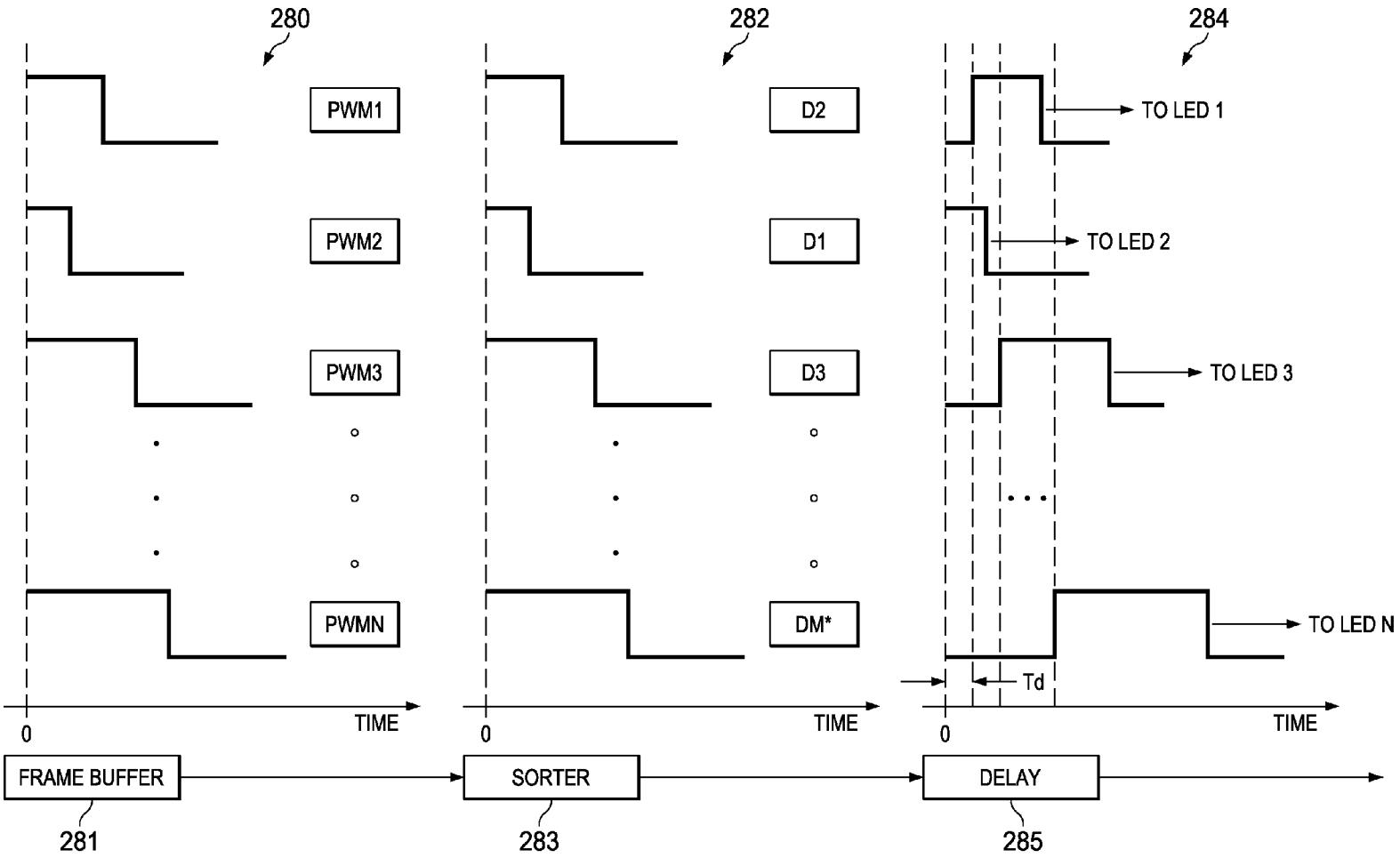
FIG. 7 is an example of a timing diagram showing pulse width modulated drive signals for the LEDs of FIG. 1.

Referring to FIG. 1, in order to overcome the problems associated with the transients, the control signals for the LEDs 102 are analyzed so that the number of simultaneous on and off transitions is limited. Reference is made to FIG. 7, which is a timing diagram showing an example of the PWM signals that may be received and processed by the circuit 100, FIG. 1. The data is received in the form of frames, wherein a first frame is received and processed. The circuit 100 displays data representative of the first frame while a second frame is received and processed. Accordingly, the displayed data is delayed. A blanking of all the LEDs 102 may occur between the frames. Each frame can be divided into many sub-frames based on the desired frame rate and the PWM resolution. Some of the sub-frames will be active and others may be disabled depending on the required light intensity.

The data received from the microprocessor is shown in the timing diagram 280. The data may be in a serial format and stored in a frame buffer 281. There are N number of PWM signals received into the frame buffer wherein each of the N PWM signals controls a single one of the LEDs 102. For example PWM1 controls the first LED in the string of LEDs 102 and PWM2 controls the second LED in the string of LEDs 102. In the embodiment wherein the circuit 100 controls sixteen LEDs 102, there are sixteen PWM signals received into the frame buffer 281.

As stated above, the PWM signals determine the amount of time that each of the LEDs 102 is on. In the embodiments of FIG. 7, the high portion of the PWM signals represents the amount of time that one of the LEDs 102 is on. However, the high portion could also represent the amount of time that one of the LEDs 102 is off. It is noted that all the PWM signals may turn on at the same time, which may be after the blanking period. In other embodiments, the PWM signals may turn on during the frame period.

The PWM signals are sorted by a sorter 283 as shown in the diagram 282 so that each PWM signal is assigned a delay. The PWM signals are sorted so that the delays are ordered from the shortest PWM signal to the longest. With regard to the embodiment of FIG. 7, PWM2 has the shortest signal and is assigned delay one (D1). PWM1 has the second shortest signal and is assigned delay two (D2) followed by PWM3, which is assigned delay three (D3). A reference signal PWMN is the last PWM signal and is assigned delay M, where M is an integer less or equal to N.

Now that the delays have been established, they are implemented by the delay 285 as shown by the timing diagram 284. The delay may increment each of the PWM signals by a period of Td, which may be a few microseconds to a few milliseconds. The delay is based on the system response and is set so that there is enough of a delay for transients to dampen. The transient associated with PWM2 will dampen before PWM1 turns on. As shown, the signal PWM2 is the shortest, so it is not delayed. PMW1 is the second shortest, so it is delayed by the period Td. PWM3 is the third shortest, so it is delayed by an amount of two times Td. As briefly described above, transients can be generated by having too many of the LEDs 102 turn off at the same time. By sorting the PWM signals from shortest to longest, the PWM signals will not turn off at the same time during a frame. In some embodiments, there is no delay applied when one LED turns on at the same time that a second LED turns off. The effects of the simultaneous on and off transitions cancel and no relevant transients are generated. In the case where there is no signal to display, for example when a sub-frame is not active, power savings can be implemented by disabling the current source 150 completely.

Having described some primary embodiments of the circuit 100, other embodiments will now be described. Reference is made to FIG. 3, which is the current source 150 that provides a current source for the LEDs 102. As stated above, the LEDs 102 operate from a voltage that is typically much higher than the voltage required for the controller 192. For example, the controller 192 may have digital and analog circuitry that operates at a few volts. The LEDs 102, on the other hand, are typically driven by voltages ranging from ten to several hundred volts. The controller 192 may use a different supply than that provided for the LEDs 102, which is expensive and may occupy a relatively large area on a circuit. The controller 192 could also convert the DC voltage used to supply the current for the LEDs 102, but such DC to DC conversions are very inefficient.

Figure 8:
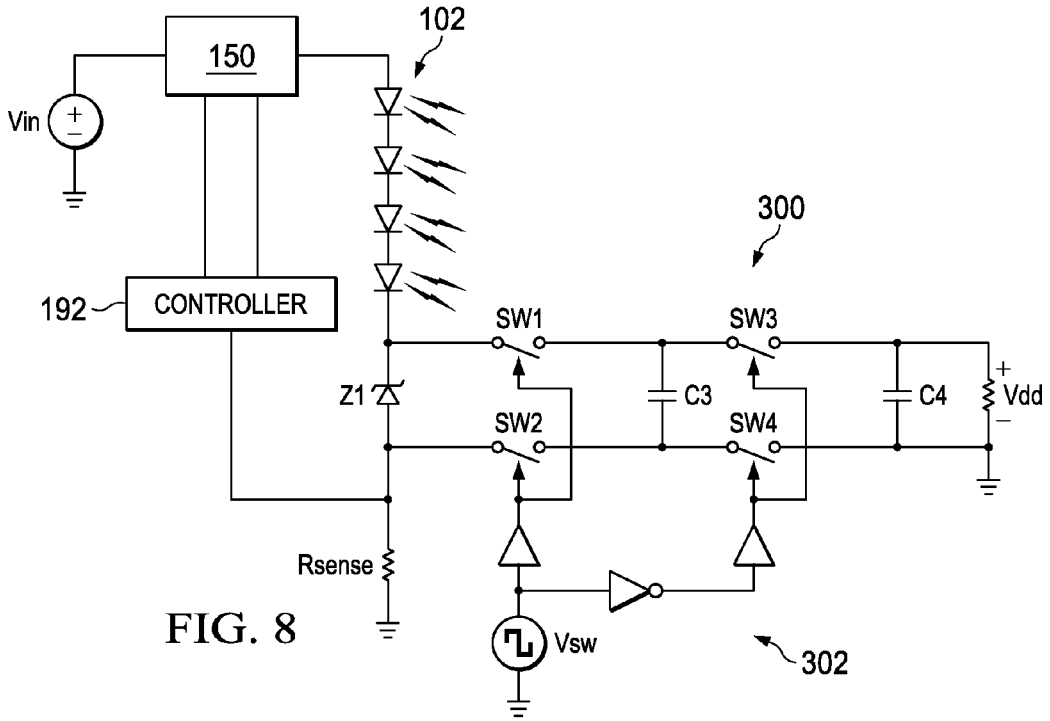
FIG. 8 is an embodiment of a circuit for converting the current supplying the LEDs of FIG. 1 to a low voltage source.

A circuit 300 for efficiently converting the current supplying the LEDs 102 to a voltage for supplying the controller 192 is shown in FIG. 8. A zener diode Z1 is connected in series with the LEDs 102. The zener diode Z1 has a voltage that is equal to the operating voltage of the controller 192, which is referred to as Vdd. The zener diode Z1 converts the current flow through the LEDs 102 to the operating voltage. Two capacitors C3 and C4 are charged by switches SW1-SW4, which are controlled by a switching circuit 302. The switching enables the voltage Vdd to be referenced to ground.

Figure 9:
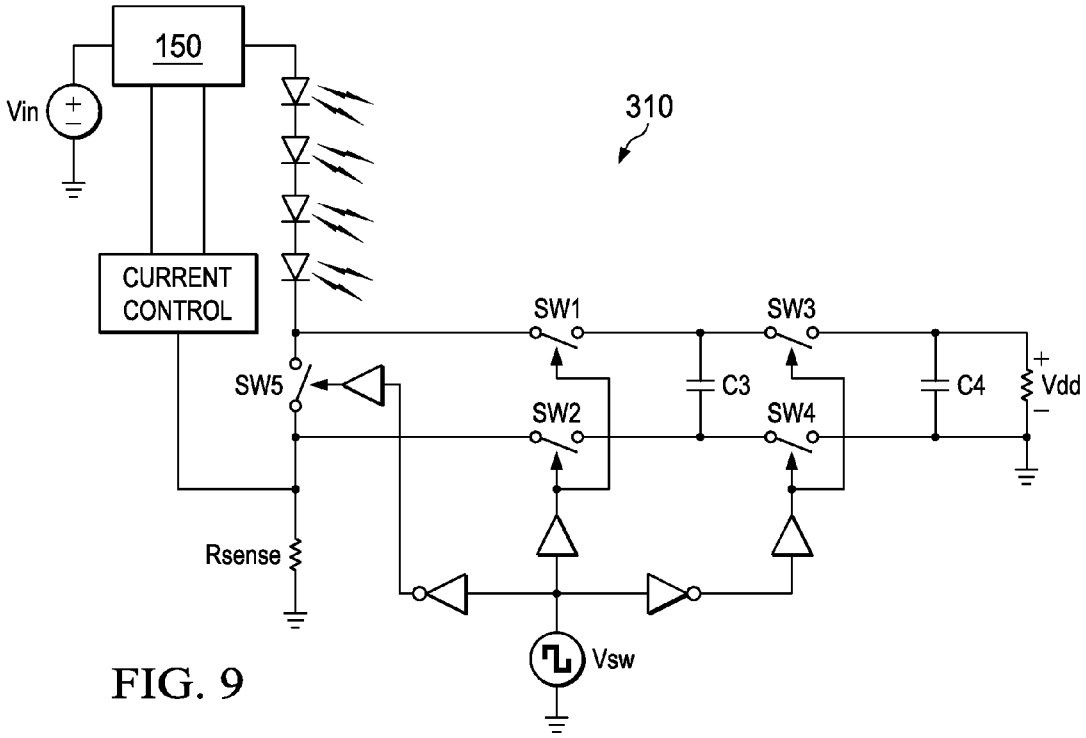
FIG. 9 is another embodiment of a circuit for converting the current supplying the LEDs of FIG. 1 to a low voltage source.

Another circuit 310 for efficiently converting the current supplied to the LEDs 102 to a voltage for supplying the controller 192 is shown in FIG. 9. The circuit 310 is similar to the circuit 300. However, the circuit 310 uses a switch SW5 in place of the zener diode Z1. The switch SW5 controls the charging time of the capacitor C3, which in turn controls the output voltage Vdd. It is noted that the switch SW5 and the combination of SW1 and SW2 operate in opposite states so that one is off while the other is on. Therefore, current is always able to flow through the LEDs 102.

Figure 10:
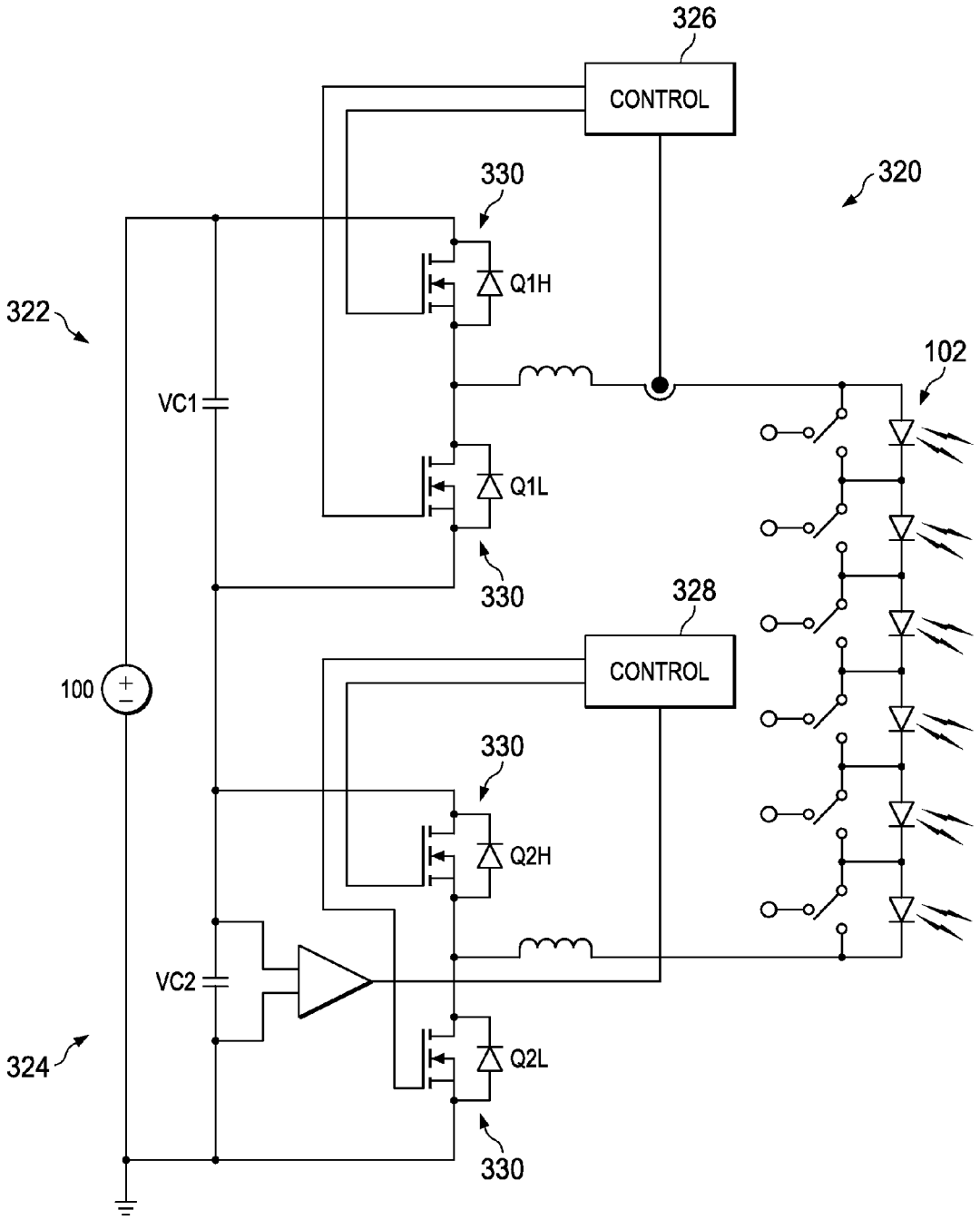
FIG. 10 is an embodiment of series current regulators that balance their input voltage.

Referring to the current source 150 of FIG. 3, more efficiency can be achieved by stacking current regulators in series across the high input voltage. One problem with having series regulators is balancing the voltages across the regulators. A circuit 320 that balances the voltage across series regulators is shown in FIG. 10. The circuit 320 includes a first current source 322 and a second current source 324, wherein the first current source 322 is substantially similar to the current source 150 of FIG. 3. The first current source 322 includes a first controller 326 and the second current source 324 includes a second controller 328. Each current source 322, 324 has switches or FETs 330 that are controlled by the controllers 326, 328.

The series connections of the regulators 322, 324 enables voltage balancing between the regulators 322, 324, which enables the FETs 330 to have lower voltages across them. The first regulator 322 provides the current source for the LEDs 102. The second current source 324 regulates the input voltage to the converters 322, 324 in order to balance the voltages across the converters 322, 324.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A circuit for controlling a plurality of first LEDs connected in series, the circuit comprising:

a plurality of switches, wherein each switch is connectable between an anode and a cathode of one of the plurality of first LEDs, each of the switches having a first state wherein current does not pass through the switch and a second state wherein current passes through the switch;

a first data input for receiving data to program the switches;

a data line for transferring data between a circuit controlling second LEDs that are connected in parallel with the first LEDs and the circuit;

a data output for transferring data to other circuits controlling third LEDs that are connected in series with the first LEDs, wherein the data for controlling the switches is in pulse width modulation format and wherein the circuit further comprises a data sorter, wherein the data sorter sorts the pulse width modulated signals based on their on time; and further comprising a charge pump, wherein the charge pump converts the voltage supplied to at least one of the first LEDs to the voltage required to operate the circuit for controlling the first LEDs, wherein a Zener diode is placed in series with the voltage supplied to at least one of the first LEDs, a voltage across the Zener diode being input to the charge pump to generate an operating voltage for the circuit for controlling the first LEDs.

2. The circuit of claim 1 and further comprising a level shift, wherein the level shift makes the voltage levels associated with the data compatible with the operating voltage of the circuit.

3. The circuit of claim 1, wherein the charge pump has an output that is electrically connectable to the circuit that controls the third LEDs.

4. The circuit of claim 1 and further comprising a fault detector, wherein the fault detector determines if one of the first LEDs is functioning.

5. The circuit of claim 4, wherein the fault detector transmits data when a fault is detected with one of the first LEDs.

6. The circuit of claim 4, wherein the fault detector measures the voltage between the anode and cathode of one of the first LEDs.

7. The circuit of claim 4, wherein the switch associated with a faulty one of the first LEDs is placed into the second state to cause current to bypass the faulty LED.

8. The circuit of claim 1 and further comprising a current source, wherein the current source drives the first LEDs, the current source comprising:

a voltage input having a first node and a second node;

an output node;

a first switch connected between the first node and the output node, wherein the first switch is controlled by a controller;

a second switch connected between the output node and the second node, wherein the second switch is controlled by the controller; and an inductor connected between the output node and the LEDs.

9. The circuit of claim 8, and further comprising a current sensor that senses the current through the inductor, wherein the current sensor has an output connected to the controller, and wherein the controller controls the first switch and the second switch based on the current sensed by the current sensor.

10. The circuit of claim 1 and further comprising a second data input that receives data from the circuit controlling the third LEDs.

11. The circuit of claim 10 wherein the data output is connectable to the second data input.

12. The circuit of claim 1 and further comprising a delay, wherein the switch with the shortest on time is turned on first.

13. The circuit of claim 1, wherein the data is received in the format of a plurality of frames and wherein all of the switches are in the second state at the start of each frame.

14. The circuit of claim 13 and further comprising a current source that drives the LEDs and wherein the current source is disabled when all of the switches are in the second state.

15. The circuit of claim 1 wherein the charge pump charges a first capacitor during a first phase of a switching circuit and charges a second capacitor from the first capacitor during a second phase of the switching circuit in order to generate a voltage referenced to ground.

16. A device for controlling a plurality of LEDs, the device comprising:

a first circuit for controlling a first plurality of LEDs, the first circuit comprising:

a data line;

a plurality of switches, wherein each switch is connectable between the anode and cathode of one of the first plurality of LEDs, each of the switches having a first state wherein current does not pass through the switch and a second state wherein current passes through the switch, wherein data received on the data line controls the states of the switches;

a second circuit for controlling a second plurality of LEDs, wherein the first plurality of LEDs are connectable in series with the second plurality of LEDs, the second circuit comprising:

a first data line connectable to the data line of the first circuit;

a second data line connectable to a processor;

a plurality of switches, wherein each switch is connectable between the anode and cathode of one of the second plurality of LEDs, each of the switches having a first state wherein current does not pass through the switch and a second state wherein current passes through the switch, wherein data received on the second data line controls the states of the switches;

wherein data received by the second data line of the second circuit is analyzed to determine if the data is to control the switches in the first circuit, when the data is not to control the switches in the first circuit, the data is transmitted to the second circuit by way of the first data line; and further comprising a charge pump, wherein the charge pump converts the voltage supplied to at least one of the first LEDs to the voltage required to operate the circuit for controlling the first LEDs, wherein a Zener diode is placed in series with the voltage supplied to at least one of the first LEDs, a voltage across the Zener diode being input to the charge pump to generate an operating voltage for the circuit for controlling the first LEDs.

17. The device of claim 16 and further comprising a third circuit for controlling a third plurality of LEDs, the third circuit comprising:

a data line connectable to the second data line of the second circuit;

a plurality of switches, wherein each switch is connectable between the anode and cathode of one of the third plurality of LEDs, each of the switches having a first state wherein current does not pass through the switch and a second state wherein current passes through the switch, wherein data received on the data line controls the states of the switches;

wherein data received by the data line controls the switches in the third circuit.

18. The device of claim 16 and further comprising a current source, wherein the current source drives the first plurality of LEDs and the second plurality of LEDs, the current source comprising:

a voltage input having a first node and a second node;

an output node;

a first switch connected between the first node and the output node, wherein the first switch is controlled by a controller;

a second switch connected between the output node and the second node, wherein the second switch is controlled by the controller; and an inductor connected to the output node and connectable to the second plurality of LEDs.

19. A circuit for controlling a plurality of first LEDs connected in series, the circuit comprising:

a plurality of switches, wherein each switch is connectable between the anode and cathode of one of the plurality of first LEDs, each of the switches having a first state wherein current does not pass through the switch and a second state wherein current passes through the switch;

a first data input for receiving data to program the switches, wherein the switches are controlled by pulse width modulated signals;

a data line for transferring data between a circuit controlling second LEDs that are connected in parallel with the first LEDs and the circuit;

a data output for transferring data to other circuits controlling third LEDs that are connected in series with the first LEDs;

a data sorter, wherein the data sorter sorts the pulse width modulated signals based on their on time;

a delay, wherein the switch with the shortest on time is turned on first;

a current source comprising:

a voltage input having a first node and a second node;

an output node;

a first switch connected between the first node and the output node, wherein the first switch is controlled by a controller;

a second switch connected between the output node and the second node, wherein the second switch is controlled by the controller; and an inductor connected to the output node and connectable to the second plurality of LEDs; and further comprising a charge pump, wherein the charge pump converts the voltage supplied to at least one of the first LEDs to the voltage required to operate the circuit for controlling the first LEDs, wherein a Zener diode is placed in series with the voltage supplied to at least one of the first LEDs, a voltage across the Zener diode being input to the charge pump to generate an operating voltage for the circuit for controlling the first LEDs.

20. A circuit for controlling a plurality of first LEDs connected in series, the circuit comprising:

a plurality of switches, wherein each switch is connectable between an anode and a cathode of one of the plurality of first LEDs, each of the switches having a first state wherein current does not pass through the switch and a second state wherein current passes through the switch;

a first data input for receiving data to program the switches;

a data line for transferring data between a circuit controlling second LEDs that are connected in parallel with the first LEDs and the circuit; and a data output for transferring data to other circuits controlling third LEDs that are connected in series with the first LEDs;

further comprising a control circuit for driving each one of the switches independently with PWM signals to individually dim the LEDs; and further comprising a charge pump, wherein the charge pump converts the voltage supplied to at least one of the first LEDs to the voltage required to operate the circuit for controlling the first LEDs, wherein a switch is placed in series with the voltage supplied to at least one of the first LEDs, a voltage across the switch being input to the charge pump to generate an operating voltage for the circuit for controlling the first LEDs.

21. A circuit for controlling a plurality of first LEDs connected in series, the circuit comprising:

a plurality of switches, wherein each switch is connectable between an anode and a cathode of one of the plurality of first LEDs, each of the switches having a first state wherein current does not pass through the switch and a second state wherein current passes through the switch;

a first data input for receiving data to program the switches;

a data line for transferring data between a circuit controlling second LEDs that are connected in parallel with the first LEDs and the circuit;

a data output for transferring data to other circuits controlling third LEDs that are connected in series with the first LEDs, wherein the data for controlling the switches is in pulse width modulation format and wherein the circuit further comprises a data sorter, wherein the data sorter sorts the pulse width modulated signals based on their on time; and further comprising a charge pump, wherein the charge pump converts the voltage supplied to at least one of the first LEDs to the voltage required to operate the circuit for controlling the first LEDs, wherein a switch is placed in series with the voltage supplied to at least one of the first LEDs, a voltage across the switch being input to the charge pump to generate an operating voltage for the circuit for controlling the first LEDs.

22. The circuit of claim 21 wherein the charge pump charges a first capacitor during a first phase of a switching circuit and charges a second capacitor from the first capacitor during a second phase of the switching circuit in order to generate a voltage referenced to ground.

* * * * *